US009265322B2

(12) United States Patent
Chan

(10) Patent No.: US 9,265,322 B2
(45) Date of Patent: Feb. 23, 2016

(54) HAIR PIN OPENER APPARATUS AND SYSTEM

(71) Applicant: Conair Corporation, Stamford, CT (US)

(72) Inventor: Lai Sheung Chan, North Point (HK)

(73) Assignee: CONAIR CORPORATION, Stamford, CT (US)

( * ) Notice: Subject to any disclaimer, the term of this patent is extended or adjusted under 35 U.S.C. 154(b) by 99 days.

(21) Appl. No.: 14/035,456

(22) Filed: Sep. 24, 2013

(65) Prior Publication Data

US 2015/0083159 A1 Mar. 26, 2015

(51) Int. Cl.
*A45D 8/18* (2006.01)

(52) U.S. Cl.
CPC ..... *A45D 8/185* (2013.01)

(58) Field of Classification Search
CPC ..... A45D 8/00; A45D 8/02; A45D 8/06; A45D 8/08; A45D 8/18; A45D 8/185; A45D 2200/25
See application file for complete search history.

(56) References Cited

U.S. PATENT DOCUMENTS

| | | | |
|---|---|---|---|
| 2,150,144 | A | 3/1939 | Andersen |
| 2,262,223 | A | 11/1941 | Chessin |
| 2,340,894 | A | 2/1944 | Morrell |
| 2,406,060 | A | 8/1946 | Byron |
| 2,434,047 | A | 1/1948 | McArthur |
| 2,438,172 | A | 3/1948 | Johnson |
| 2,439,870 | A | 4/1948 | Sharp, Sr. |
| 2,441,947 | A | 5/1948 | Welch |
| 2,445,373 | A | 7/1948 | Turner |
| 2,460,562 | A | 2/1949 | Worrell |
| 2,480,581 | A | 8/1949 | Hopkins |
| 2,489,579 | A | 11/1949 | King |
| 2,506,859 | A | 5/1950 | Des Saulles |
| 2,507,031 | A | 5/1950 | Maggio et al. |
| 2,509,897 | A | 5/1950 | Williams et al. |
| 2,513,971 | A | 7/1950 | Skinner |
| 2,528,991 | A | 11/1950 | Auman |
| 2,529,385 | A | 11/1950 | Guss |
| 2,535,170 | A | 12/1950 | Stephenson |
| 2,543,356 | A | 2/1951 | Deuillet |
| 2,544,595 | A | 3/1951 | Haase |
| 2,546,528 | A | 3/1951 | Snyder |
| 2,548,561 | A | 4/1951 | Sewol |
| 2,551,991 | A | 5/1951 | Armstrong et al. |
| 2,571,481 | A | 10/1951 | Peguero |
| 2,576,822 | A | 11/1951 | Bartsch |
| 2,600,092 | A | 6/1952 | Buelow |
| 2,602,456 | A | 7/1952 | Le Master |

(Continued)

OTHER PUBLICATIONS

Walmart, Goody Products, Jun. 6, 2010.*

*Primary Examiner* — Rachel Steitz
(74) *Attorney, Agent, or Firm* — Carter, DeLuca, Farrell & Schmidt, LLP

(57) ABSTRACT

A method, apparatus and system for storing and distributing hairpins for application to the hair of a subject, includes a support having a support surface, a plurality of hairpins releasably coupled to the support and an opener mounted to the support. The opener includes a base segment defining a longitudinal axis and having opposed generally diverging side segments. The base segment at least partially extends beyond the support surface of the support to orient the diverging side segments in position whereby legs of each hairpin may be advanced along the diverging side segments to displace the legs to cause opening thereof.

12 Claims, 8 Drawing Sheets

(56) References Cited

U.S. PATENT DOCUMENTS

| | | | |
|---|---|---|---|
| 2,606,563 | A | 8/1952 | Hayden |
| 2,662,533 | A | 12/1953 | Swanson et al. |
| 2,687,736 | A | 8/1954 | Bohmholdt |
| 2,710,612 | A | 6/1955 | Reilly |
| 2,796,871 | A | 6/1957 | Mussy |
| 2,832,355 | A | 4/1958 | Mater et al. |
| 2,833,291 | A | 5/1958 | Campagna |
| 3,016,058 | A | 1/1962 | Clayton |
| 3,413,983 | A | 12/1968 | Halstead |
| 3,905,380 | A | 9/1975 | Bontempi |
| 3,927,685 | A | 12/1975 | Bontempi |
| 4,219,034 | A | 8/1980 | Nemish |
| 4,270,554 | A | 6/1981 | Lazzaro |
| 4,553,557 | A | 11/1985 | Johnson |
| 4,974,613 | A | 12/1990 | Ho |
| 5,682,908 | A | 11/1997 | Chou |

* cited by examiner

HAIR PIN OPENER APPARATUS AND SYSTEM

BACKGROUND

1. Technical Field

The present disclosure relates to hair styling systems, and, more particularly, relates to a system, method and apparatus for application of hairpins to the hair of a subject.

2. Description of Related Art

Hairpins such as "bobby pins" are known in the art. Hairpins are usually made from resilient material including metallic or polymeric legs connected through a hinge or bent portion. Generally, during application, hairpins are removed from the package, opened and applied to a length of hair. However, removal and opening of the hairpins often proves to be an awkward or cumbersome process.

SUMMARY

Accordingly, the present disclosure is directed to a method, apparatus and system for storing and distributing hairpins for application to the hair of a subject. In accordance with one embodiment, a hairpin storage and application system includes a support having a support surface, a plurality of hairpins releasably coupled to the support and an opener mounted to the support. The opener includes a base segment defining a longitudinal axis and having opposed generally diverging side segments. The base segment at least partially extends beyond the support surface of the support to orient the diverging side segments in position whereby legs of each hairpin may be advanced along the diverging side segments to displace the legs to cause opening thereof.

The opener may include a flange segment connected to the base segment. The flange segment is dimensioned to extend beyond the diverging side segments of the base segment to assist in retaining the hairpin relative to the diverging side segments as the legs of the hairpin are advanced therealong. The opener may includes first and second flange segments connected to the base segment, with the first flange segment dimensioned to assist in retaining the hairpin relative to the diverging side segments, and the second flange segment dimensioned to facilitate securement of the pin opener to the support. The second flange segment may be coupled to the support. The diverging side segments each have a tapered segment defining an asymmetric profile relative to the longitudinal axis.

In one embodiment, the support is a placard. The support may includes at least one opening extending therethrough dimensioned for storing the hairpins with the legs of each the pin extending through the at least one opening and respectively disposed adjacent on opposed surfaces of the support. The support may include a plurality of openings extending therethough dimensioned for storing the hairpins.

In accordance with another embodiment, a hairpin opener apparatus for opening a hairpin of the type having a pair of resilient legs interconnected by a hinge and being biased to a normally closed position. The hair pin opener apparatus includes a base segment defining a longitudinal axis and having opposed generally diverging side segments diverging with respect to the longitudinal axis from a front end of the base segment to a rear end of the base segment. The diverging side segments are arranged whereby the resilient legs of the hairpin may be advanced along respective diverging side segments to displace the legs relative to each other to cause at least partial opening thereof. The diverging side segments may define an asymmetric surface.

BRIEF DESCRIPTION OF THE DRAWINGS

Various embodiments of the present disclosure are described hereinbelow with references to the drawings, wherein.

DETAILED DESCRIPTION OF THE PREFERRED EMBODIMENTS

Figures 1, 2:
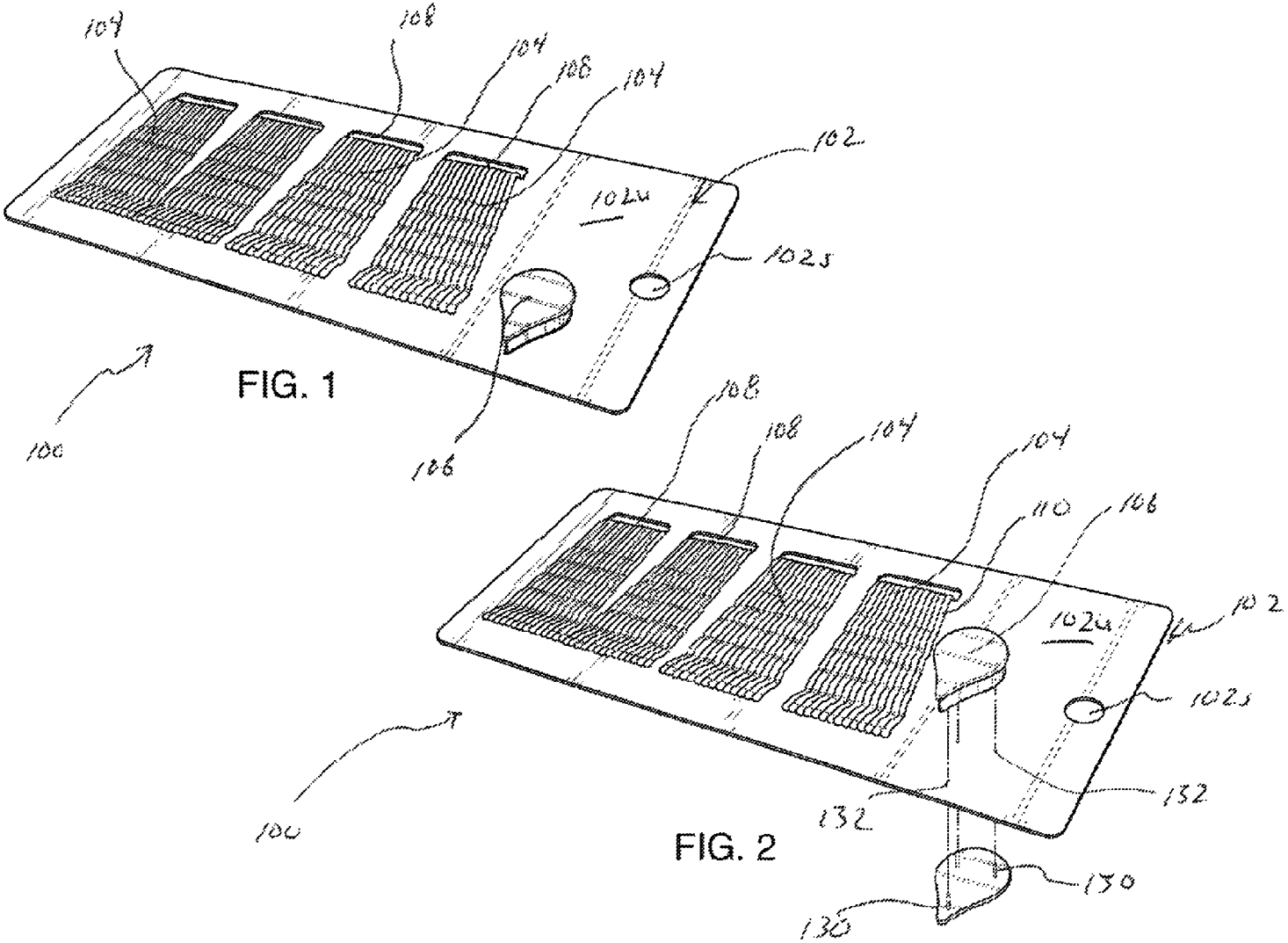
FIG. 1 is a perspective view of the HAIRPIN OPENER AND APPLICATION SYSTEM in accordance with the principles of the present disclosure illustrating the pin support, a plurality of pins mounted to the support and the pin opener.
FIG. 2 is a perspective view similar to the view of FIG. 1 of the SYSTEM illustrating the pin opener removed from the pin support.

Referring now in detail to the drawings and, in particular, to FIGS. 1-8, the hairpin and application system in accordance with the principles of the present invention is illustrated. The hairpin and application system 100 includes a hairpin support 102, a plurality of hair clips or pins 104 mounted to the support 102 and a pin opener 106. The pin support 102 includes a plurality of slots or openings 108 extending therethrough which receive the hairpins 104. Four openings 108 are shown although more or less than four are contemplated. The openings 108 are spaced relative to each other to facilitate storage and removal of the hairpins 104 from the pin support 102. It is contemplated that each opening 108 may contain a predetermined number of hairpins 104 specific to its intended use on the subject's hair. The pin support 102 may be in the form of a placard fabricated from any suitable rigid material including, e.g., cardboard, molded polymeric material, etc. The pin support 102 may have a supplemental opening 102*s* to receive a display post of a display rack or the like. The pin support 102 defines an upper surface 102*u* and a lower surface 102*l*.

Figure 4:
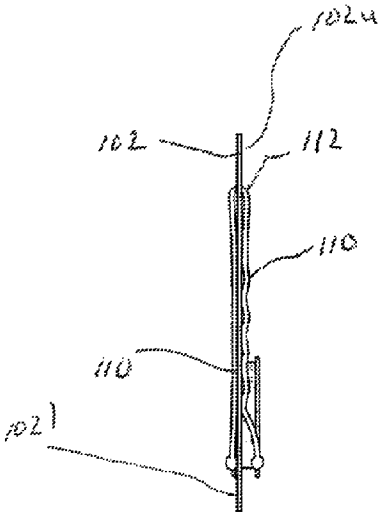
FIGS. 3-4 are first and second end elevation views of the SYSTEM.
Figure 3:
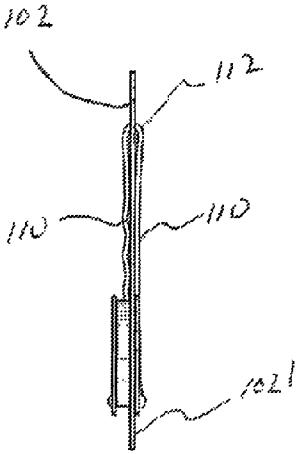
Figure 5:
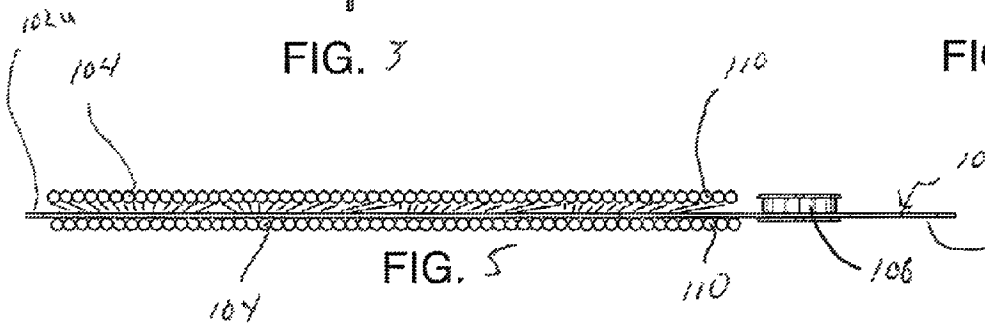
FIGS. 5-6 are first and second side elevation views of the SYSTEM.
Figure 6:
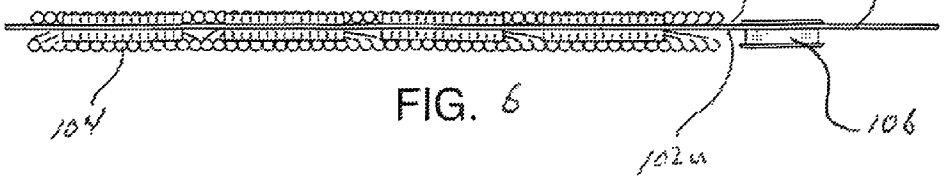
Figure 7:
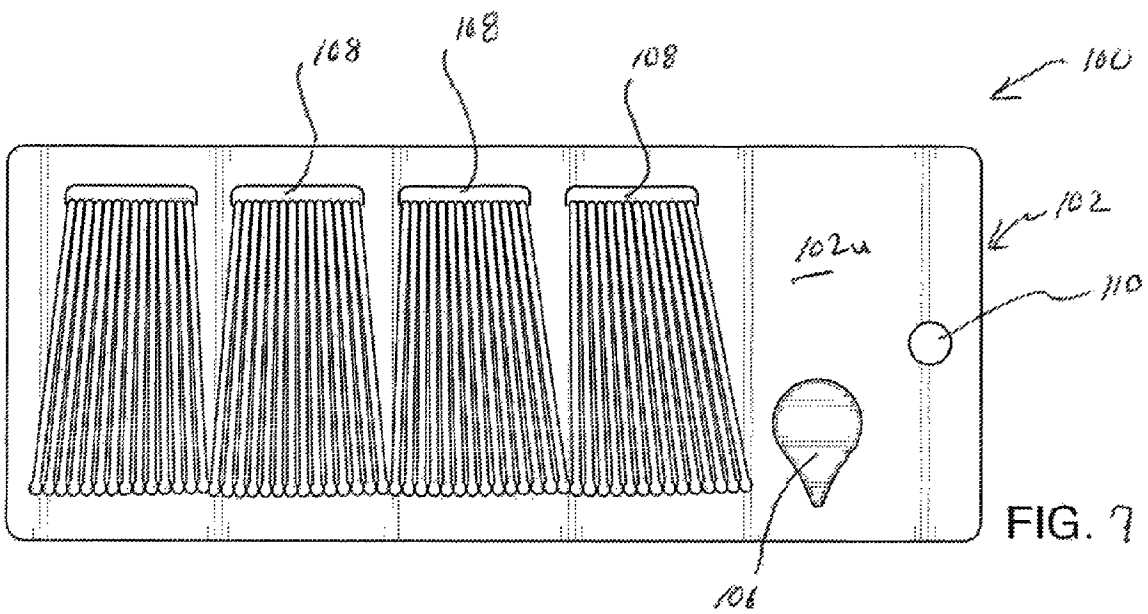
FIGS. 7-8 are first and second plan views of the SYSTEM.
Figure 8:
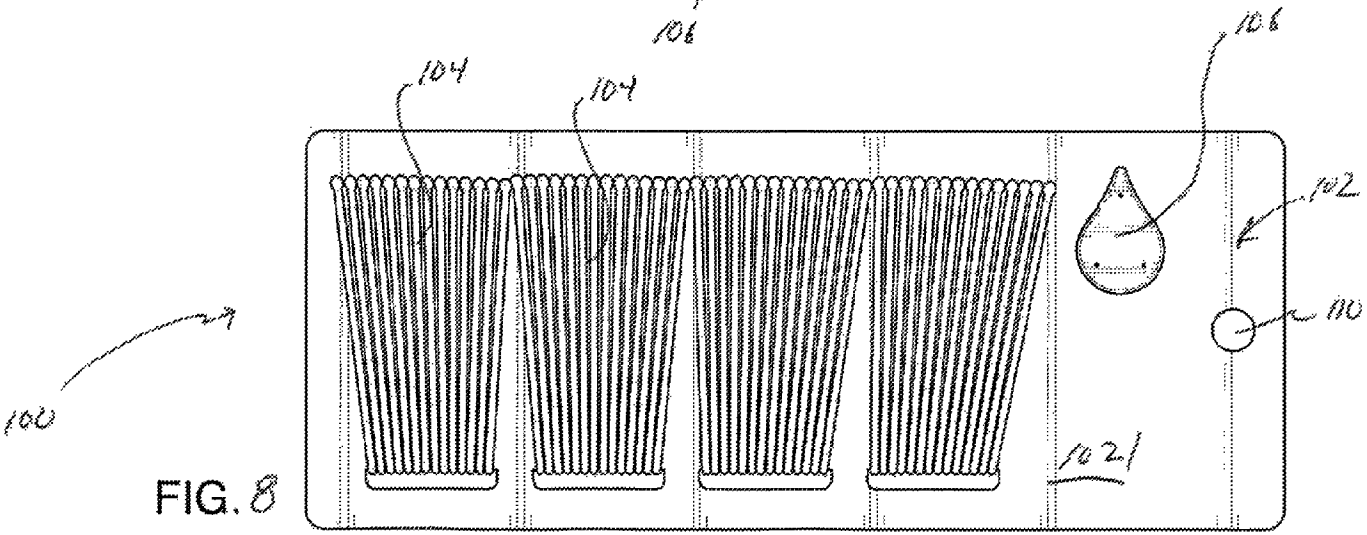
Figure 9:
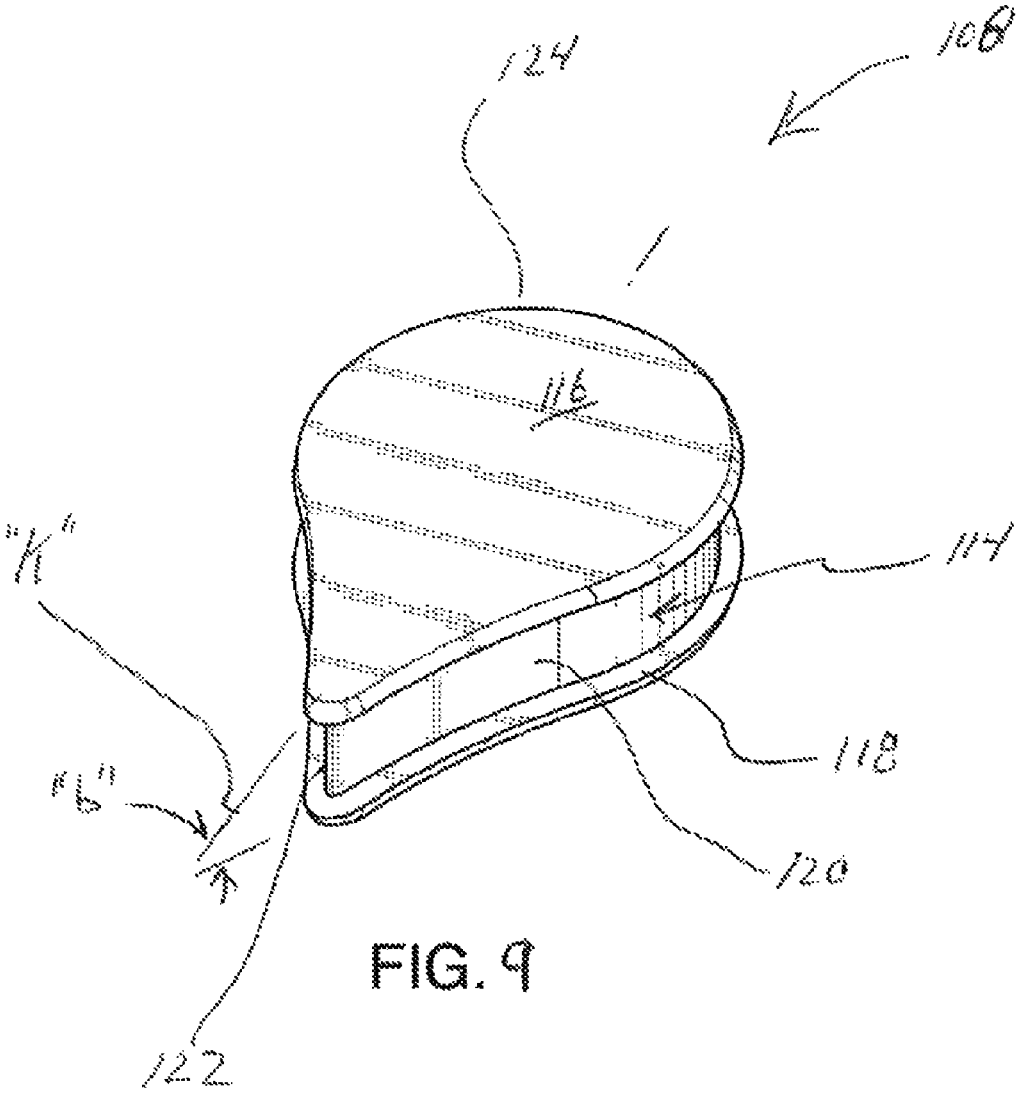
FIG. 9 is a perspective view of the pin opener of the SYSTEM illustrating the base segment and the upper and lower flange segments connected to the base segment.
Figure 10:
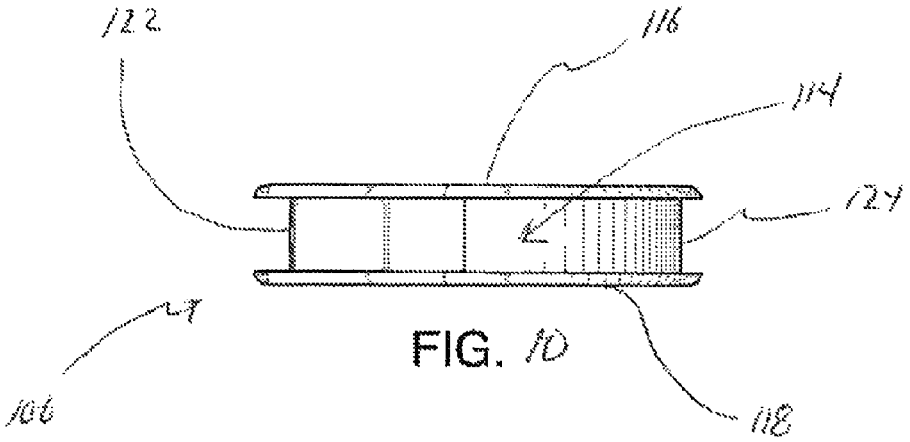
FIG. 10 is a side elevation view of the pin opener.
Figure 11:
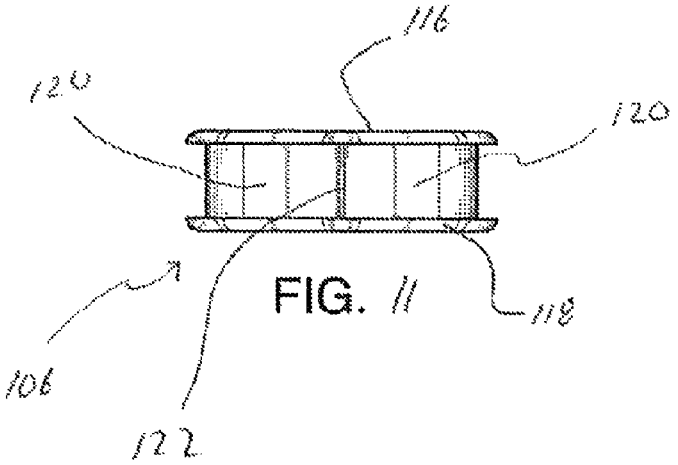
FIGS. 11-12 are front and rear axial views, respectively, of the pin opener.
Figure 12:
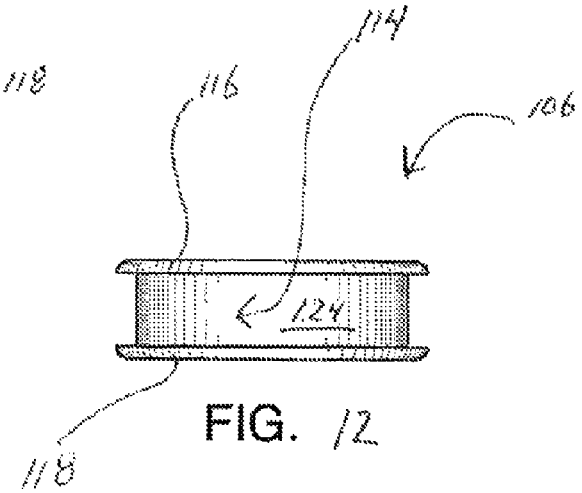
Figure 13:
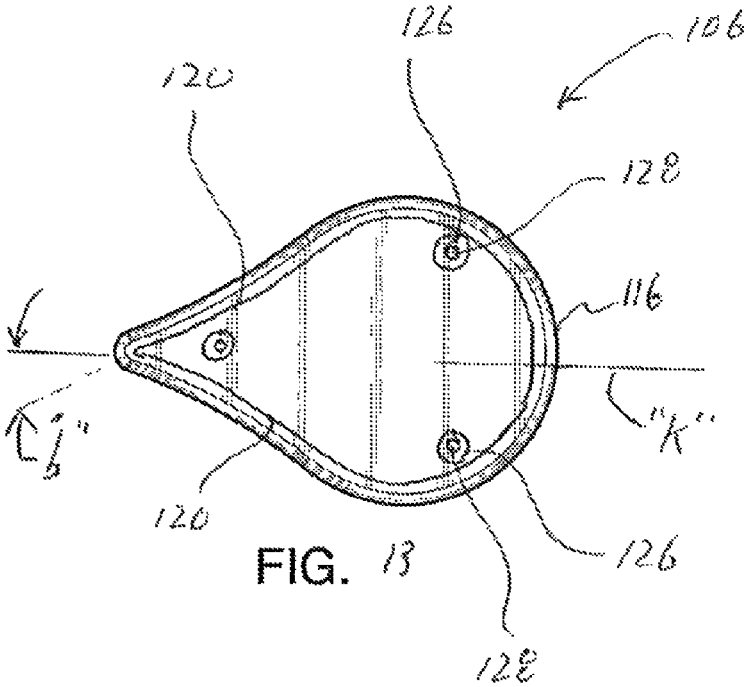
FIG. 13 is a view of the inner side of the upper flange segment illustrating the mounting columns for connection to the lower flange segment.
Figure 14:
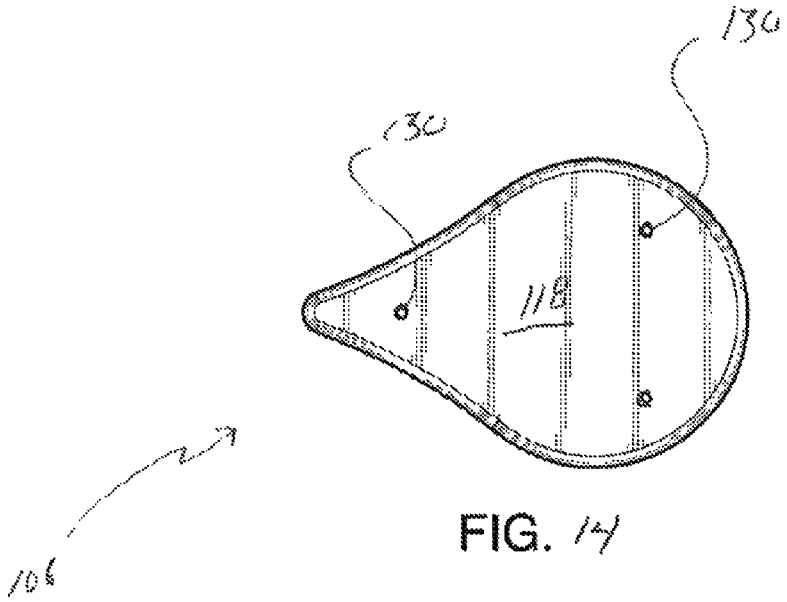
FIG. 14 is a view of the inner side of the lower flange segment illustrating the mounting posts for connection to mounting columns of the upper flange segment.

The hairpins 104 are of conventional design (e.g., bobby pins) incorporating a pair of resilient legs 110 interconnected by a hinge 112 (FIGS. 3 and 4). The legs 110 are normally biased toward the closed position shown in the drawings. The legs 110 may be displaced relative to each other (e.g., pivoted outwardly about the hinge 112) and placed about a section of hair of the subject. Upon release of the displaced legs 110, the legs 110 tend toward their normally closed position secured about the section of hair. The hairpins 104 may be fabricated from a resilient plastic or metallic material. The hairpins 104 are mounted to the pin support 102 by positioning one leg 110 through a respective opening 108 of the pin support 102 and advancing the hairpin 104 such that the hinge 112 is at least partially received within the opening 108. The normal bias of the legs 110 toward the closed position will retain the hairpin 104 on the pin support 102, i.e., the legs 110 securely engage the pin support 102 on the opposed upper and lower sides 102*u*, 102*l* thereof.

With reference now to FIGS. 9-14, the pin opener 106 will be discussed. The pin opener 106 includes a base segment 114 and first (upper) and second (lower) flange segments 116, 118 mounted on opposed ends of the base segment 114. The base segment 114 defines a longitudinal axis "k" and has opposed generally diverging side segments 120. The diverging side segments 120 taper outwardly relative to the longitudinal axis "k" from the front end 122 of the base segment 114 toward the rear end 124 of the base segment 114. The diverging side segments 120 each may define an angle of taper "b" relative to the longitudinal axis "k" which continuously changes from the front end 122 of the base segment 114 toward the rear end of the base segment 114. This provides a generally asymmetric, hyperbolic or parabolic profile to the diverging side segments 120, which creates benefits with respect to opening of the hairpin 104 about the pin opener 106 as will be discussed. (See FIGS. 9 and 13) In the alternative, the diverging side segments 120 may define multiple angles relative to the longitudinal axis "k" or the angle of taper "b" may be constant. The diverging side segments 120 meet at the front end 122 of the base segment 114 to define a narrow profile about which the legs 110 of the hairpin 104 are positioned. The rear end 124 of the base segment 114 is generally round or arcuate.

The upper and lower flange segments 116, 118 each may define an outer periphery generally corresponding in shape to the outer periphery of the base segment 114. In embodiments, the upper and lower flange segments 116, 118 are generally larger than the base segment 114 (when viewed in plan) such that the flange segments 116, 118 extend beyond the outer periphery of the base segment 114. This assists in maintaining the hairpin 106 relative to the base segment 114 during use of the pin opener 106. The upper and lower flange segments 116, 118 may be monolithically formed with the base segment 114 or may be separate components mountable to the base segment 114 through conventional means. In one embodiment best depicted in FIGS. 12-13, in conjunction with FIG. 2, at least the lower flange segment 118 is separate from the base segment 114 and the upper flange segment 116 is monolithically formed with base segment 114. The inner side of the upper flange segment 116 includes a plurality of mounting columns 126 defining mounting openings 128. The inner side of the lower flange segment 118 includes a plurality of mounting posts 130. The mounting posts 130 are dimensioned and adapted to be passed through corresponding openings 132 with the support 102 (FIG. 2) to be received with the mounting openings 128 of the mounting columns 126 to connect the components. A snap fit or frictional relationship established between the mounting posts 130 and the mounting columns 126 may maintain the components connected. In accordance with this embodiment, the mounting posts 130 may be secured within the mounting openings 128 through the establishment of a frictional relationship between the components, a snap fit relation, adhesives, cements, and/or combinations of any of these means etc.

With reference again to FIGS. 1-6, the pin opener 106 is mounted to the pin support 102 in a manner to present the diverging side segments 120 of the base segment 114 to the user for application of the hairpin 104. For example, the lower flange segment 118 may be secured to the lower surface 1021 of the pin support 102 such that major portions of the diverging side segments 120 are disposed above the upper surface 102*u* of the pin support 102. With this orientation, the diverging side segments 120 may be readily accessed to enable ready positioning of the legs 110 of the clip 104 about the front end 122 of the base segment 114 of the pin opener 106. In particular, the legs 110 of each hairpin 106 may be advanced along the diverging side segments 120 to displace the legs 110 to cause opening thereof. The base segment 114 may extend for a distance above the upper surface 102*u* of the pin support 102 ranging from about 2 millimeters to about 8 millimeters. The lower flange segment 118 may be secured to the pin support 102 with the use of adhesives or cements to also assist in securing the pin opener 106 to the pin support 102, and maintaining the desired elevated orientation of the upper flange segment 116 relative to the pin support 102.

Figure 15:
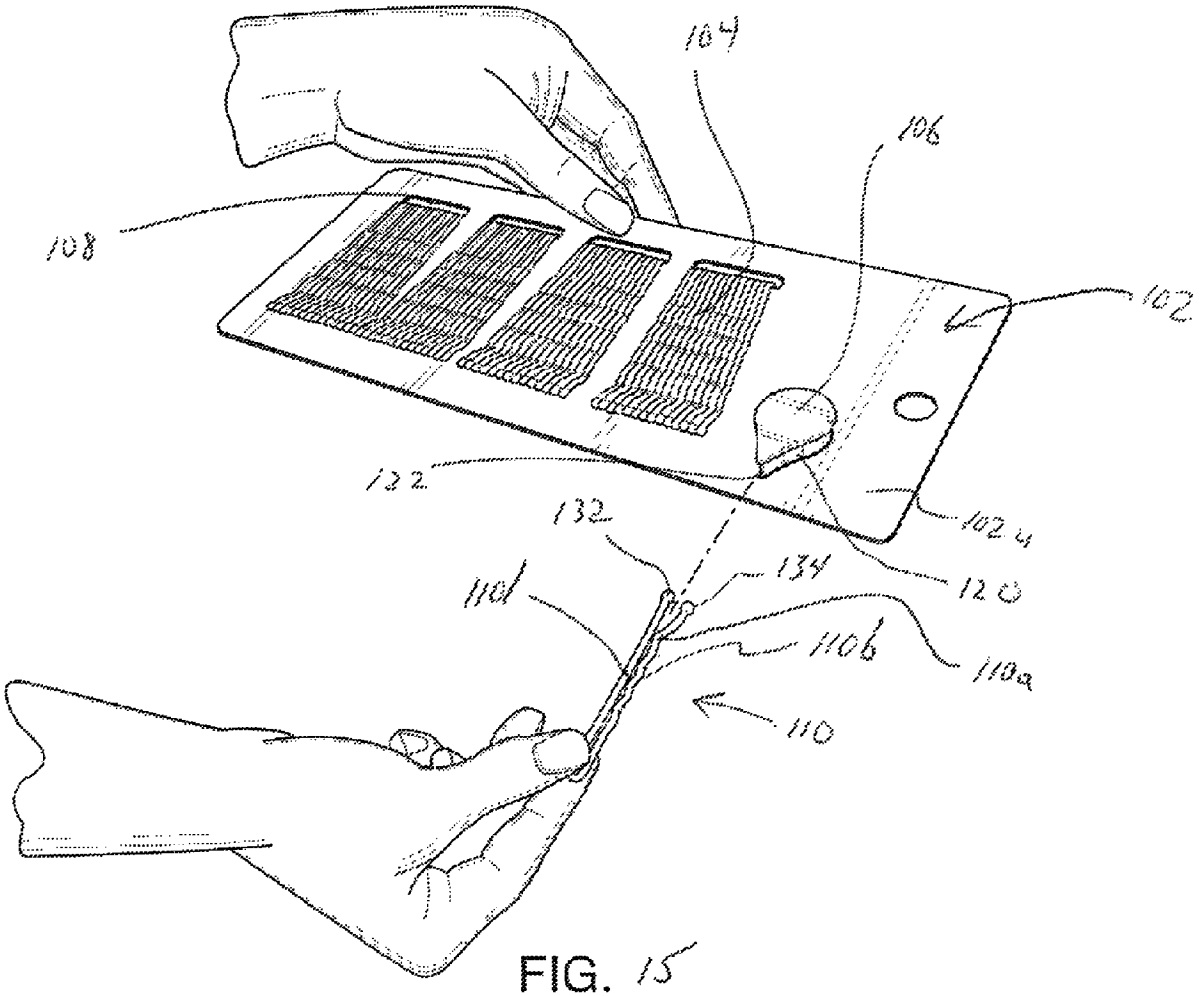
FIGS. 15-16 are views illustrating a sequence of operation of use of the SYSTEM.
Figure 16:
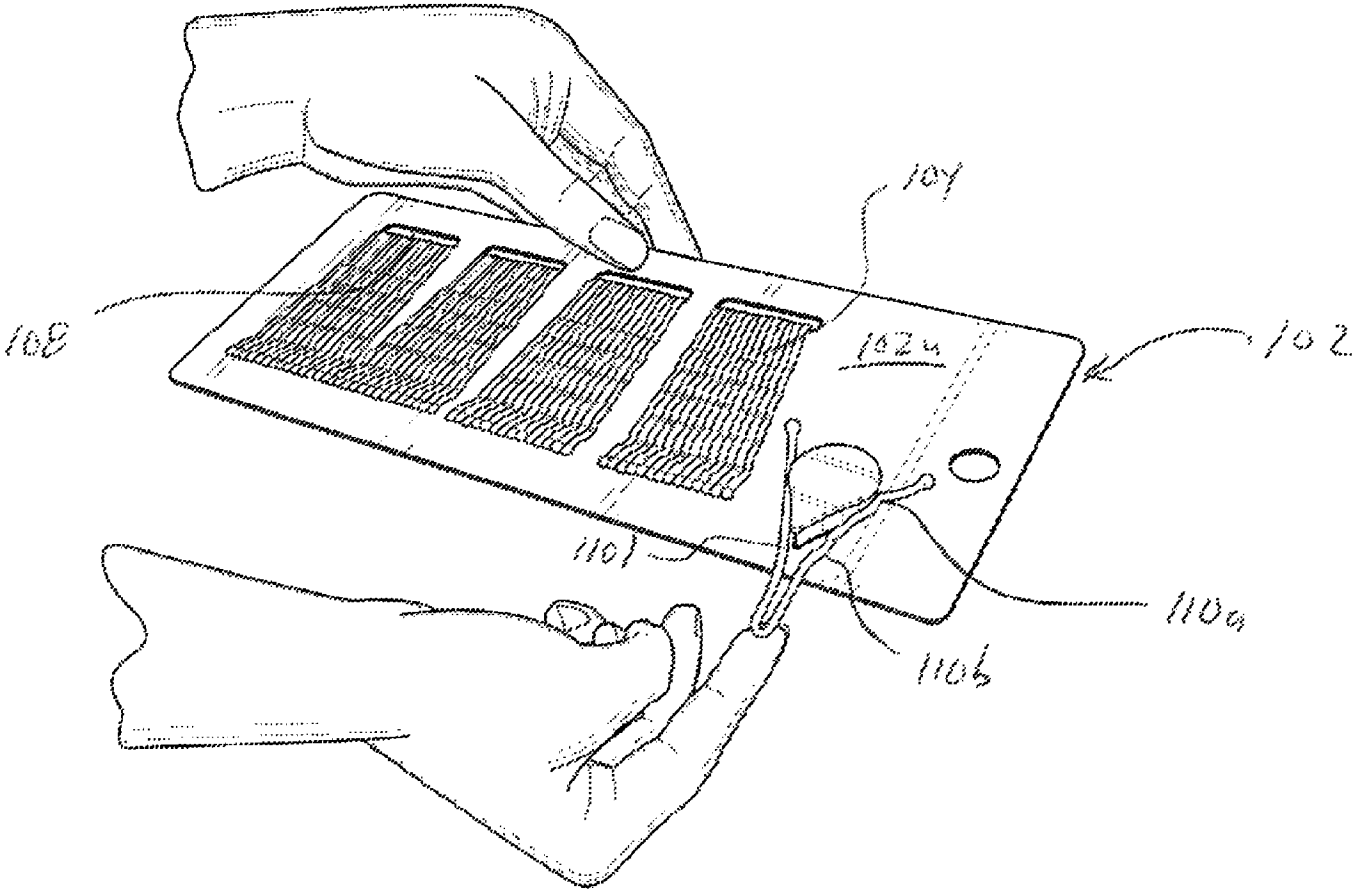

Referring now to FIGS. 15-16, the use of the system will now be discussed. The user removes a single hairpin 104 from the pin support 102. The hairpin 104 is oriented relative to the pin opener 106 with the free ends of the legs 110 aligned with the front end 122 of the pin opener 106. The hairpin 106 is advanced with respective legs 110 contacting the opposed diverging side segments 120. Upon advancement onto the base segment 114 of the pin opener 106, the legs 110 of the hairpin 104 slide on the diverging side segments 120 and move to an open position. The non-linear (e.g., hyperbolic or parabolic) profile of the diverging side segments 120 of the base segment 114 minimizes contact of the legs 110 with the diverging side segments 120 thereby reducing friction between the components and facilitating advancement of the hairpin 104 on the pin opener 106. For example, the enlarged head 132 of the linear leg 110 of the hair clip 104 will contact the respective diverging side 120 and, due to the asymmetric profile of the diverging side 120, contact is maintained generally with the enlarged head 132 while contact between the linear leg 110*l* behind the enlarged head is minimized. Similarly with the bent leg 110*b*, the enlarged head 134 and possibly the first bend apex 110*a* contacts the diverging side 110 while contact of the remaining segment of the bent leg 110*b* is minimized. During advancement of the hair clip 110, the upper flange segment 116 and the upper surface 102*u* of the clip support 102 will prevent the hairpin 104 from sliding off the base segment 114 during advancement of the hairpin 106. Once opened, the hairpin 104 is grasped by the subject and applied to the hair in conventional manner.

The above description and the drawings are provided for the purpose of describing embodiments of the present disclosure and are not intended to limit the scope of the disclosure in any way. It will be apparent to those skilled in the art that various modifications and variations can be made without departing from the spirit or scope of the disclosure. Thus, it is intended that the present disclosure cover the modifications and variations of this disclosure provided they come within the scope of the appended claims and their equivalents.

What is claimed is:

1. A hairpin storage and application system, which comprises:

a planar support having a first support surface and a second opposed support surface;

a plurality of hairpins releasably coupled to said support; and an opener mounted to said support, said opener including:

a base segment defining a longitudinal axis and having opposed generally diverging side segments, said base segment at least partially extending beyond said first support surface of said support to orient said diverging side segments in position whereby legs of each hairpin may be advanced along said diverging side segments to displace said legs to cause opening thereof;

a first flange segment connected to said base segment and disposed adjacent said first support surface of said support, said first flange segment extending beyond said diverging side segments of said base segment to assist in retaining said hairpin relative to said diverging side segments as said legs of said hairpin are advanced therealong; and a second flange segment secured to said base segment and disposed on said second support surface of said support.

2. The hairpin storage and application system according to claim 1, wherein said second flange segment is dimensioned to extend beyond said diverging side segments of said base segment to facilitate securement of said second flange segment relative to said support.

3. The hairpin storage and application system according to claim 2, wherein said second flange segment is secured to said second support surface of said support.

4. The hairpin storage and application system according to claim 1, wherein said diverging side segments each have a tapered segment defining an asymmetric profile relative to said longitudinal axis.

5. The hairpin storage and application system according to claim 1, wherein said support is a placard.

6. The hairpin storage and application system according to claim 1, wherein said support includes at least one hair pin opening extending through said support from said first support surface to said second opposed support surface, said at least one hair pin opening dimensioned for storing said hairpins with said legs of each said pin extending through said at least one hair pin opening and respectively disposed adjacent respective first and second support surfaces of said support.

7. The hairpin storage and application system according to claim 6, wherein said support includes a plurality of hair pin openings extending through said support from said first support surface to said second opposed support surface and being dimensioned for storing said hairpins.

8. The hairpin opener apparatus according to claim 1, wherein said support defines at least one support opening extending through said support from said first support surface to said second support surface.

9. The hairpin storage and application system according to claim 8, wherein one of said base segment and said second flange segment has at least one mount extending through said at least one support opening of said support, the other of said base segment and said second flange segment has at least one corresponding mounting opening dimensioned to receive said at least one mount to couple said second flange segment to said base segment and to said support.

10. The hairpin storage and application system according to claim 9, wherein said support defines at least two support openings extending therethrough, and wherein said one of said base segment and said second flange segment has at least two mounts depending therefrom and extending through respective said at least two support openings of said support, and wherein said other of said base segment and said second flange segment has at least two corresponding mounting openings dimensioned to respectively receive said at least two mounts to couple said second flange segment to said base segment and to said support.

11. The hairpin storage and application system according to claim 10, wherein said support defines three support openings extending therethrough, and wherein said one of said base segment and said second flange segment has three mounts depending therefrom and extending through respective said three support openings of said support, and wherein said other of said base segment and said second flange segment has three corresponding mounting openings dimensioned to respectively receive said three mounting members to couple said second flange segment to said base segment and to said support.

12. The hairpin storage and application system according to claim 10, wherein said other of said base segment and said second flange segment has at least two mounting columns which define said at least two mounting openings.

* * * * *